US005363639A

United States Patent [19]

Stahlecker et al.

[11] Patent Number: 5,363,639

[45] Date of Patent: Nov. 15, 1994

[54] SPINNING MACHINE WITH SPINNING STATIONS COMPRISING ONE DRAFTING UNIT RESPECTIVELY

[76] Inventors: Fritz Stahlecker, Josef-Neidhart-Strasse 18, 7347 Bad Überkingen; Hans Stahlecker, Haldenstrasse 20, 7334 Sussen, both of Germany

[21] Appl. No.: 993,592

[22] Filed: Dec. 22, 1992

[30] Foreign Application Priority Data

Jan. 22, 1992 [DE] Germany ..... 4201575

[51] Int. Cl.[5] ..... D01H 13/04

[52] U.S. Cl. ..... 57/315; 57/81; 57/87; 57/90

[58] Field of Search ..... 57/90, 315, 78, 80, 57/81, 83, 86, 87, 102; 192/18 A, 91 A

[56] References Cited

U.S. PATENT DOCUMENTS 1,462,896 7/1923 Barksdale et al. ..... 57/83
1,470,351 10/1923 Cushman et al. ..... 57/83
2,623,348 12/1952 Bade ..... 57/83
3,312,050 4/1967 Noguera ..... 57/90
3,805,931 4/1974 Portmann ..... 192/18 A
4,176,514 12/1979 Stalder ..... 57/83 X
4,581,881 4/1986 Lamb ..... 57/80 X

FOREIGN PATENT DOCUMENTS 1015780 1/1966 United Kingdom .

*Primary Examiner*—Joseph J. Hail, III
*Attorney, Agent, or Firm*—Evenson, McKeown, Edwards & Lenahan

[57] ABSTRACT

In the case of a spinning machine with several spinning stations, which each comprise a drafting unit, and with depositing sites for cans containing sliver, transport devices are provided for transporting the slivers from the cans to the drafting units. The transport devices as well as the drafting units comprise devices which can interrupt the transport of an individual sliver.

15 Claims, 2 Drawing Sheets

SPINNING MACHINE WITH SPINNING STATIONS COMPRISING ONE DRAFTING UNIT RESPECTIVELY

BACKGROUND AND SUMMARY OF THE INVENTION

This invention relates to a spinning machine with spinning stations, which comprise one drafting unit respectively, with depositing sites for cans containing sliver, and with transport devices for the transporting of the slivers from the cans to the spinning stations.

A spinning machine of this type, which is constructed as a ring spinning machine, is the state of the art based on the British Patent Document GB-PS 10 15 780. The transport devices comprise two transport belts for each spinning station which form a transport belt pair which receives a sliver between one another and transports it. Directly in front of the drafting unit, one of these transport belts winds around a drivable delivery roller. The delivery roller may tap its drive by way of a frictional wheel selectively from the feeding bottom cylinder of the pertaining drafting unit or—for an accelerated first-time drawing-in of a sliver—from a driving roller which can be driven much faster.

An interruption of the sliver transport in the case of a yarn breakage or other disturbance is not provided. However, in the case of a yarn breakage, there is the risk that the sliver which continues to be fed to the drafting unit leads to a lap formation at the delivery bottom cylinder of the drafting unit. The delivery bottom cylinders of the drafting units may be bent by means of such laps.

In the older German Patent Application P 41 24 312.9, corresponding to pending U.S. application Ser. No. 07/914,414, titled "Spinning Machine", which is no prior publication, it was suggested to stop the transport belt in the case of a yarn breakage while the drafting unit continues to run. This has the result that the sliver will tear off at any point between the transport device and the drafting unit so that, after the yarn breakage is eliminated, only a short starting piece of sliver will be available which does not permit a fast start of the operation of the spinning station.

In a further German Patent Application P 41 27 490.3, corresponding to pending U.S. application Ser. No. 07/886,813, titled "Ring Spinning Machine", which is also no prior publication, it was suggested that a transport belt of the transport device at the same time wind around the feeding bottom roller of the drafting unit so that the feeding bottom roller is at the same time the delivery roller for the transport belt. This delivery roller has a sleeve which can be uncoupled from a drivable shaft and is assigned to only one spinning station. Therefore the feeding roller pair of the drafting unit can be stopped together with the transport belt in the case of a yarn breakage. Such a construction is suitable only for short transport belts which have no bends because otherwise the feeding bottom roller of the drafting unit would be stressed by excessive lateral forces.

It is an object of the invention to largely avoid, in the case of a spinning machine of the initially mentioned type, disturbances in the drafting unit caused by a yarn breakage and thus difficulties with respect to a new start of its operation.

This object is achieved according to preferred embodiments of the invention in that the transport devices as well as the drafting units comprise devices which are controlled by means of a yarn detector detecting a faulty spinning unit and which interrupt the transport of an individual sliver.

In the case of this development, not only is the transport of the sliver in the transport device as well as in the drafting unit stopped, but at the same time the sliver remains threaded in the drafting unit so that the start of the operation can be fast when the operation of the spinning unit is started again. A fully automatic operation is also made possible in this manner.

At least the feeding bottom roller is expediently stopped in the case of the drafting unit. As experience has shown, it will then be possible, particularly in the case of three-cylinder drafting units, to restart the operation of the spinning unit in such a manner that the sliver is automatically placed in the remaining roller pairs. However, as an alternative, it is contemplated to also stop additional roller pairs of the drafting unit in the case of a yarn breakage.

Advantageously, the transport device comprises at least one transport belt to which a delivery roller is assigned which can be stopped. In this case, the transport belt may be wound around the delivery roller and the delivery roller may be arranged directly in front of the drafting unit.

In an advantageous development of the invention, the feeding bottom roller and the delivery roller are constructed as sleeves which can be coupled to a drive shaft which extends through in the longitudinal direction of the machine. In this case, the machine-side drives of the feeding bottom roller and of the delivery roller can continue to run while the feeding bottom roller and the delivery roller itself can nevertheless be stopped.

Advantageously, the devices for interrupting the transport of the sliver are operated pneumatically according to certain preferred embodiments of the invention. Since nowadays spinning machines normally have pneumatic connections anyhow, a simple and economical operation is possible in this manner. In this case, during the normal spinning operation, the devices are expediently acted upon by excess pressure which can be reduced in the case of a disturbance. This has the result that, in the case of a disturbance, for example, in the case of a power failure, the excess pressure-will no longer exist so that in such a case the transport devices and the drafting units are necessarily stopped.

In a further development of the invention, the yarn detector is arranged on a carriage which can be moved along the spinning machine and is assigned to several spinning stations. This has the advantage that only one yarn detector, which periodically monitors the spinning stations, is required for a plurality of spinning stations. Experience has shown that such a periodic monitoring is possible in the case of certain spinning machines, particularly in the case of ring spinning machines.

Other objects, advantages and novel features of the present invention will become apparent from the following detailed description of the invention when considered in conjunction with the accompanying drawings.

DETAILED DESCRIPTION OF THE DRAWINGS

Figure 1:
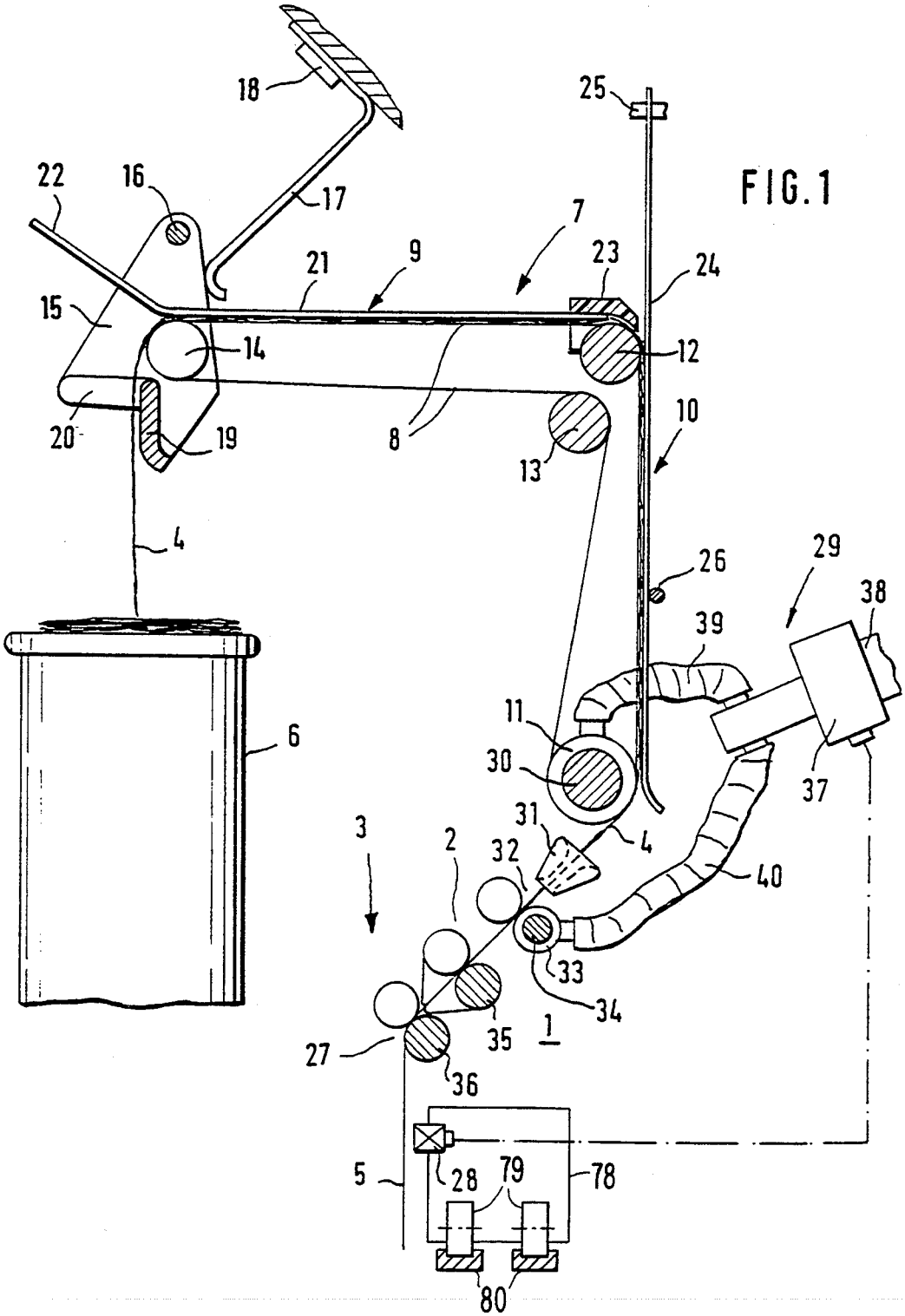
FIG. 1 is a partially sectional lateral schematic view of a spinning machine according to the invention.

In FIG. 1, only one drafting unit 2 of a spinning station 3 is shown of a spinning machine 1. This may be a ring spinning machine, in the case of which a ring spindle, which is not shown, is connected behind the drafting unit 2 in a known manner. Normally, a plurality of spinning stations 3 are arranged next to one another in the longitudinal direction on both machine sides of the spinning machine 1.

The spinning machine is used for spinning slivers 4 into yarns 5, a sliver 4 being assigned to each spinning station 3 which is withdrawn from a can 6. As a rule, the cans 6 are deposited in a manner which is not shown in several rows next to one another along the spinning machine 1 because the diameter of the cans 6 is larger than the spacing of the spinning stations 3 in the longitudinal direction of the machine.

A transport device 7 is used for the withdrawal of the sliver 4 from the can 6 as well as for the feeding of the sliver 4 to the drafting unit 2. This transport device 7 comprises a continuous transport belt 8 which has an angular course between the can 6 and the pertaining drafting unit 2 and preferably consists of an essentially horizontal run 9 and an essentially vertical run 10.

The transport belt 8 is wound around a delivery roller connected directly in front of the drafting unit 2 and, in addition, is guided by way of three additional deflecting pulleys 12, 13, and 14. The deflecting pulleys 12 and 13 are closely adjacent to one another and are situated at the transition point of the horizontal run 9 to the vertical run 10 of the transport device 7. The deflecting pulleys 12 and 13 are mounted on shafts extending through in the longitudinal direction of the machine but are freely rotatable.

The deflecting pulley 14 arranged above the can 6 is constructed as a tension roller for the transport belt 8 and thus as an individual pulley for each spinning station 3. It is freely rotatably arranged on a holder 15 which can be swivelled about a shaft 16 fixed to the machine. The tension force for the deflecting pulley 14 is generated by a leaf spring 17 which presses against the holder 15 and which is fastened to a holding device 18 fixed to the machine.

Between the can 6 and the deflecting pulley 14, the holder 15 is provided with a sliver guide 19 which guides the sliver 4 to the deflecting pulley 14, on the one hand, and, on the other hand, also holds it in the correct position in the longitudinal direction of the machine by means of lateral cheeks 20.

Along the horizontal run 9, the transport belt 8 is covered from above by a skid 21. On the side facing the transport belt 8, this skid 21 has a smooth surface and presses the sliver 4 by means of a slight contact pressure onto the surface of the transport belt 8. In this case, the sliver 4 is slightly pressed and stretched. In the area in front of the deflecting pulley 14, the skid 21 has an upwardly bent lengthening 22 by means of which, when necessary, the skid 21 can be lifted upward off the transport belt 8, for example, for the inserting of a new sliver 4 after a batch change.

In the area of the deflecting pulley 12, the skid 21 is provided with a sliver guide 23 which, on the one hand, is used for the deflection of the sliver 4 from the horizontal run 9 to the vertical run 10 and which, on the other hand forms a stop in the transport direction for the skid 21 against the deflecting pulley 12.

Another skid 24 is assigned to the vertical run 10 and is suspended above the deflecting pulley 12 in a holding device 25 and is placed against the transport belt 8 with a slight contact pressure by means of a rod 26 extending in the longitudinal direction of the machine.

In the case of a breakage of the spun yarn 5, particularly the delivery roller pair 27 of the drafting unit 2 of the faulty spinning station 3 is in danger. In particular, laps may be formed there. In order to prevent this, it is provided that the transport of the sliver 4 in the transport device 7 as well as in the drafting unit 2 are interrupted in the case of a disturbance. In this case, it must be possible to restart the operation without significant delay after the disturbance is eliminated.

For the monitoring of a disturbance at a spinning station 3, particularly the determining of a breakage of the yarn 5, a yarn detector 28 is used which may be arranged on each spinning station 3 but which may, as an alternative, be situated on a carriage which can be moved along the spinning machine 1 and is not shown so that the spinning stations 3 are monitored only periodically. If a disturbance is determined, the yarn detector 28 may activate devices 29 for interrupting the transport of the sliver 4 in the transport device 7 as well as in the drafting unit 2.

So that the delivery roller 11 of the transport device 7 can be stopped, it is constructed, in a manner that will be described in the following, as a sleeve which can be uncoupled from a drive shaft 30. The drive shaft 30 extends through in the longitudinal direction of the spinning machine 1 and is driven by a driving head of the spinning machine 1.

At the delivery roller 11, the sliver 4 leaves the transport belt 8, travels through a feeding hopper 31 and then arrives at the feeding roller pair 32 of the drafting unit 2. For the stopping of the drafting unit 2, at least the feeding bottom roller 33 of the drafting unit 2 is also constructed as a sleeve which can be uncoupled from its drive shaft 34 extending through in the longitudinal direction of the machine. In addition to the feeding bottom roller 33 the bottom rollers 35 and 36 of the drafting unit 2 may also be constructed correspondingly according to other contemplated embodiments. However normally it is sufficient in the case of a three-cylinder drafting unit, to be able to stop only the feeding roller pair 32 together with the transport device 7. In the case of a disturbance at a spinning station 3, the sliver 4 is then interrupted in its transport but remains at least in the feeding roller pair 32 of the drafting unit 2 so that, after the elimination of the disturbance, the spinning station 3 can then be restarted without any problems.

The devices 29 for the interrupting of the transport of the sliver 4 expediently comprise a solenoid valve 37 which is arranged in a compressed-air line 38 and which, in a manner described in the following, is connected by way of compressed-air lines 39 and 40, with the individual delivery rollers 11 as well as with the individual feeding bottom rollers 33.

Figure 2:
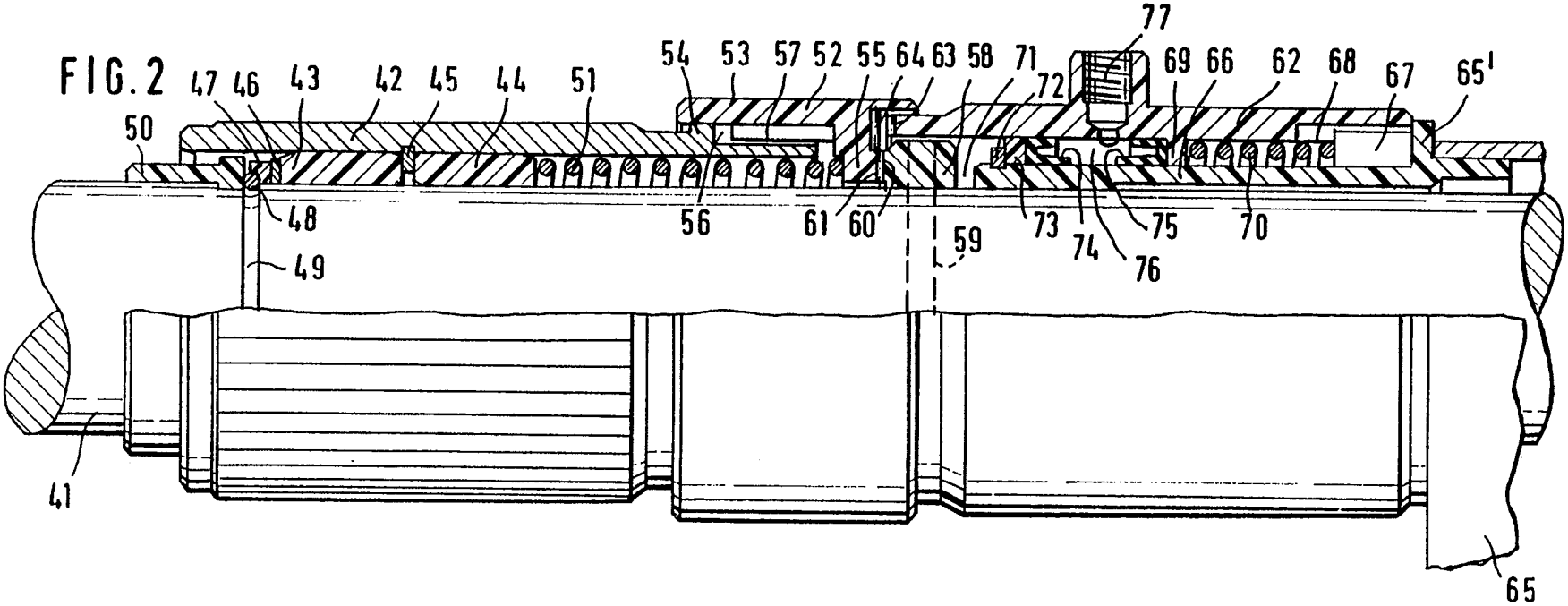
FIG. 2 is a very enlarged longitudinal sectional view of a feeding bottom roller, which can be uncoupled from its drive, and a delivery roller of a transport device, specifically during a normal spinning operation, constructed according to a preferred embodiment of the invention.
Figure 3:
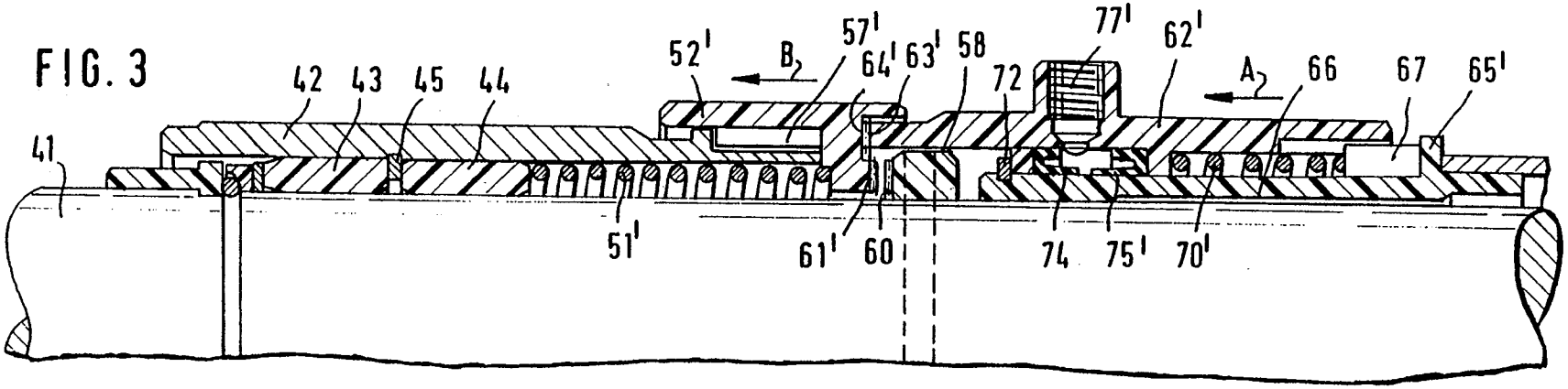
FIG. 3 is a view similar to FIG. 2, showing when a disturbance is present.

The shaft 41 illustrated in FIGS. 2 and 3 may be the drive shaft 30 as well as the drive shaft 34. By means of FIGS. 2 and 3, it is explained how the delivery roller 11 can be uncoupled from its drive shaft 30 and how the feeding bottom roller 33 can be uncoupled from its drive shaft 34. In the representation according to FIGS. 2 and 3, one sleeve respectively is illustrated for the delivery roller 11 and the feeding bottom roller 33 and is provided with the reference number 42. Therefore, the sleeve 42 of FIGS. 2 and 3 corresponds to the delivery roller 11 as well as to the feeding bottom roller 33 of FIG. 1.

FIG. 2 shows the condition in which a sleeve 42 assigned to a spinning station 3 is coupled to its drive shaft 41 extending through in the longitudinal direction of the machine and therefore rotates along with the drive shaft 41. In contrast, FIG. 3 shows the condition in which the sleeve 42 is uncoupled from its continuously rotating drive shaft 41.

By means of two slide bearings 43 and 44, the sleeve 42 is disposed on the drive shaft 41. These slide bearings 43 and 44 are two plastic sleeves which are non-rotatably pressed into the sleeve 42 before the assembly. The two slide bearings 43 and 44 are separated from one another by means of a snap ring 45 which is arranged in a groove of the sleeve 42 and which is used as an axial stop for the slide bearing 43 and 44. Toward the outside, the outer slide bearing 43 is supported by way of a steel ring 46 placed on the drive shaft 41 as well as an intermediate ring 47 made of plastic on a ring 48 which is held in a groove 49 of the drive shaft 41. A closing piece 50 forms the extreme end of the sleeve 42, this closing piece 50 being a plastic sleeve and being anchored in a groove of the drive shaft 41.

The slide bearings 43 and 44 have a slight play with respect to the drive shaft 41. In this case, the inner slide bearing 44 is used as a stop for a pressure spring 51 which rests by means of its other end against a coupling piece 52 which can be displaced in the direction of the arrow B. The coupling piece 52 is made of plastic and is constructed in the manner of a cup. Coupling piece 52 comprises a sleeve-type area 53 by means of which it is guided on the sleeve 42 with a slight play. Coupling piece 52 also comprises a disk-shaped area 55 which has a larger play with respect to the drive shaft 41.

The sleeve 42 comprises at least one radial groove 56 which is covered by the sleeve-type area 53 of the coupling piece 52. A key 57 of the coupling piece 52 slides in the groove 56. By means of this groove-key connection 56, 57 between the sleeve 42 and the coupling piece 52, the coupling piece 52 can be shifted slightly in the direction of the arrow B as well as against the direction of the arrow B, in which case it is ensured at the same time that, should the coupling piece 52 rotate, the sleeve 42 is also caused to carry out rotations.

On the side of the coupling piece 52 which faces away from the pressure spring 51, a drive ring 58 is non-rotatably fastened on the drive shaft 41. The drive ring 58 is a plastic ring which is fastened in a radial bore 59 of the drive shaft 41 by means of a pin. On the side facing the coupling piece 52, the drive ring 58 has a crown gear 60 on its face which has a very fine construction and is comparable to the known serration. A corresponding gear 61 on the face of the disk-type area 55 of the coupling piece 52 which faces the drive ring 58 is assigned to the gear 60.

When, as illustrated in FIG. 2, the gears 60 and 61 engage in one another because of the effect of the pressure spring 51, the rotating movement of the drive ring 58 connected with the drive shaft 41 is transmitted to the coupling piece 52. Because of the groove-key connection 56, 57, this rotating movement is also transmitted to the sleeve 42 which therefore rotates along with the drive shaft 41 at the same angular velocity.

When, on the other hand, as illustrated in FIG. 3, the coupling piece 52 is shifted in the axial direction in the direction of the arrow B into position 52', the key 57 connected with the sleeve-type area 53 also shifts into position 57', in which case the key 57 can also slide in the groove 56 into the direction of the arrow B. In this case, the gears 60 and 61 are disengaged, in which case the gear 61 of the coupling piece 52 in the disengaged state will then take up position 61' according to FIG. 3 in which it is separated from the gear 60 of the drive ring 58 which cannot be moved in the axial direction. In the case of the position 52' of the coupling piece 52 illustrated in FIG. 3, no rotational drive takes place affecting the sleeve 42. In this case, the pressure spring 51 is changed into a slightly compressed position 51'.

An actuating sleeve 62 is assigned to the coupling piece 52. This actuating sleeve 62 is always non-rotatable but can also be displaced in the axial direction corresponding to the direction of the arrow A, specifically into a position 62' in a manner that will be described in the following.

The actuating sleeve 62 is essentially arranged on the side of the drive ring 58 facing away from the coupling piece 52 but still covers the drive ring 58, specifically with a radial play. In the area of the drive ring 58, the actuating sleeve 62 has a gear 63 on its face which has a construction that is identical to the described gear 60 of the drive ring 58. During the operation, a face-side gear 64 of the coupling piece 52 according to FIG. 2 is situated at a slight distance opposite the gear 63 of the actuating sleeve 62. When, in a manner described in the following, the actuating sleeve 62 is moved in the axial direction according to the direction of the arrow A, the stopped gear 63 engages into the rotating gear 64, in which case the coupling piece 52 is then moved into the direction of the arrow B in to position 52' illustrated in FIG. 3. In the case of the actuating sleeve 62 situated in position 62', the gears 63 and 64 will then take up the mutually connected positions 63' and 64' so that the coupling piece 52 is separated from its rotary drive and stops immediately.

On the side of the drive ring 58 facing away from the coupling piece 52, the drive shaft 41 is disposed in a holding device 65 which is not shown in detail, is fixed to the machine and has an installed radial bearing. This holding device accommodates a bearing sleeve 65' in such a manner that it is disposed in an axially and radially unshiftable and non-rotatable manner. The bearing sleeve 65', which is made of plastic, has a sleeve-type bearing ring 66. The bearing ring 66 has a key 67 which engages in a radial groove 68 of the actuating sleeve 62 so that, also in this case, a groove-key connection 67, 68 exists by which the actuating sleeve 62 is also held in a non-rotatable but axially shiftable manner. Between the key 67 and a collar 69 of the actuating sleeve 62, a pressure spring 70 is arranged which acts in the axial direction and which endeavors to expand into a position 70' according to FIG. 3 and in the process move the actuating sleeve 62 in the direction of the arrow A into position 62' in which the coupling piece 52 takes up position 52' and thus disengages the sleeve 42 from the drive shaft 41. However, during the operation, the actuating sleeve 62 is prevented from engaging by means of its gear 63 in the gear 64 of the coupling piece 52; that is, during the normal spinning operation, the actuating sleeve 62 takes up the position illustrated in FIG. 2.

A slight axial distance 71 exists between the drive ring 58 and the bearing ring 66. In this area, the bearing ring 66 is provided with a stop ring 72 fastened to it. A ring packing 74 rests against the stop ring 72 with the insertion of a plastic ring 73. This ring packing 74 cannot be moved in the axial direction.

On the side facing away from the stop ring 72, a ring packing 75 is disposed at a distance opposite the ring packing 74. This ring packing 75 can be moved along by way of the collar 69, specifically into position 75' illustrated in FIG. 3, when the actuating sleeve 62 is shifted axially. The shifting movement illustrated in FIG. 3 is caused by pressure spring 70 which must therefore have a stronger design than pressure spring 51.

As mentioned above, during the operation, the actuating sleeve 62 is held in its position illustrated in FIG. 2, specifically against the force of the pressure spring 70. This takes place by means of compressed air which during the operation is blown into the annulus 76 between the two ring packings 74 and 75. The pressure force of the compressed air must therefore be stronger than the force of the pressure spring 70. For the feeding of the compressed air into the annulus 76, which is situated between the bearing ring 66 and the actuating sleeve 62, a compressed-air connection 77 is used. This compressed-air connection can be moved along with the actuating sleeve 62 in the axial direction, thus into a position 77' illustrated in FIG. 3. For this reason, the compressed-air connection 77, in the manner which is not shown, must be connected with a flexible line. During the normal spinning operation, the annulus 76 is constantly subjected to sufficient excess pressure.

In the case of a disturbance detected at the spinning station 3 by the yarn detector 28, the above-described solenoid valve 37 is actuated whereby the excess pressure in the annulus 76 is switched off. As a result, the actuating sleeve 62, under the force of the pressure spring 70, can move axially in the direction of the arrow A, in which case gear 63 engages in gear 64 and in the process changes the coupling piece 52 in the direction of the arrow B into a position 52' in which the gears 60 and 61 are disengaged.

The coupling piece 52, the drive ring 58 as well as the actuating sleeve 62 each are injection molded parts made of plastic so that the required gears 60, 61, 63 and 64 can be manufactured reasonably with minimal expenditures. Apart from these plastic parts, standard parts are predominantly used for the coupling of the sleeve 42 to the drive shaft 41.

FIG. 1 shows schematically a carriage 78 which moves the yarn detectors 28. The carriage 78 travels by means of wheels 79 on rails 80 along the spinning stations.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A spinning machine comprising a plurality of spinning stations, each spinning station including:

a drafting unit having a feeding roller pair;

a depositing site for a sliver supply can;

sliver transport means for transporting a sliver from said sliver supply can to said drafting unit;

means for interrupting transport of said sliver by the sliver transport means and transport of said sliver within said drafting unit such that said sliver remains at least in said feeding roller pair; and a yarn detector coupled to the means for interrupting and which controls the means for interrupting.

2. A spinning machine according to claim 1, wherein the drafting unit includes at least one feeding bottom roller which is stopped by the means for interrupting.

3. A spinning machine according to claim 2, wherein the feeding bottom roller and a delivery roller of the sliver transport means are each constructed as a sleeve, and further comprising means for selectively coupling the sleeve to a drive shaft extending through in the longitudinal direction of the machine.

4. A spinning machine according claim 3, wherein the means for interrupting are pneumatically actuatable.

5. A spinning machine according to claim 4, wherein the means for interrupting operate under excess pressure in the normal spinning operation which is reducible in the case of a disturbance.

6. A spinning machine according to claim 4, wherein the yarn detector is arranged on a carriage which can be moved along the spinning machine and is assigned to several spinning stations.

7. A spinning machine according to claim 2, wherein the transport apparatus comprises at least one transport belt and is a stoppable delivery roller.

8. A spinning machine according to claim 1, wherein the transport apparatus comprises at least one transport belt and a delivery roller which can be stopped by the means for interrupting.

9. A spinning machine according to claim 8, wherein the transport belt winds around the delivery roller which is arranged directly in front of the drafting unit.

10. A spinning machine according to claim 9, wherein a feeding bottom roller and the delivery roller of the sliver transport apparatus are each constructed as a sleeve, and further comprising means for selectively coupling the sleeve to a drive shaft extending through in the longitudinal direction of the machine.

11. A spinning machine according claim 8, wherein the means for interrupting are pneumatically actuatable.

12. A spinning machine according claim 1, wherein the means for interrupting are pneumatically actuatable.

13. A spinning machine according to claim 12, wherein the means for interrupting operate under excess pressure in the normal spinning operation which is reducible in the case of a disturbance.

14. A spinning machine according to claim 13, wherein the yarn detector is arranged on a carriage which can be moved along the spinning machine and is assigned to several spinning stations.

15. A spinning machine according to claim 1, wherein the yarn detector is arranged on a carriage which can be moved along the spinning machine and is assigned to several spinning stations.

* * * * *